US007160181B2

(12) United States Patent
Jeung

(10) Patent No.: US 7,160,181 B2
(45) Date of Patent: Jan. 9, 2007

(54) POLISHING PAD OF CMP EQUIPMENT FOR POLISHING A SEMICONDUCTOR WAFER

(75) Inventor: Gun-Ig Jeung, Hwasung-gun (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 193 days.

(21) Appl. No.: 10/866,805

(22) Filed: Jun. 15, 2004

(65) Prior Publication Data

US 2004/0255521 A1 Dec. 23, 2004

(30) Foreign Application Priority Data

Jun. 23, 2003 (KR) ..... 10-2003-0040585

(51) Int. Cl.
*B24B 1/00* (2006.01)

(52) U.S. Cl. ..... 451/285; 451/287; 451/530; 451/533

(58) Field of Classification Search ..... 457/285, 457/287, 288, 526, 530, 533, 539
See application file for complete search history.

(56) References Cited

U.S. PATENT DOCUMENTS 3,571,984 A * 3/1971 Koorneef et al. ..... 451/63
6,045,439 A * 4/2000 Birang et al. ..... 451/526
6,077,153 A 6/2000 Fujita et al.
6,454,630 B1 9/2002 Tolles
6,458,023 B1 10/2002 Moon
6,561,889 B1 * 5/2003 Xu et al. ..... 451/526
6,855,034 B1 * 2/2005 Hasegawa ..... 451/41
2001/0036805 A1 11/2001 Birang et al.

* cited by examiner

*Primary Examiner*—Eileen P. Morgan
(74) *Attorney, Agent, or Firm*—Volentine Francos & Whitt, PLLC

(57) ABSTRACT

A polishing pad used for polishing the surface of a semiconductor wafer in CMP equipment, includes a support layer adhered to the top of a rotary plate of the CMP equipment, a polishing layer disposed on top of the support layer, and an adhesive layer interposed between the support layer and the polishing layer and adhesively fixing the polishing layer to the support layer. In one embodiment, the polishing support layer is a plate-shaped molded article formed of a mixture including magnetic powder and a bonding agent containing synthetic resin. In another embodiment, a protective film extends along outer peripheral side walls of the adhesive layer and the support layer.

6 Claims, 5 Drawing Sheets

POLISHING PAD OF CMP EQUIPMENT FOR POLISHING A SEMICONDUCTOR WAFER

BACKGROUND OF THE INVENTION

1. Field of the Invention

The present invention relates to the manufacturing of semiconductor devices. More particularly, the present invention relates to a polishing pad of CMP equipment for use in polishing and planarizing the surface of a semiconductor wafer.

2. Description of the Related Art

Semiconductor devices comprise a plurality of circuit patterns stacked one atop the other on a wafer. The circuit patterns are formed by selectively and repeatedly performing numerous unit processes such as photolithography, etching, ion implantation, diffusion, and metal deposition processes. Recently, interlayer circuit patterns are being overlaid with greater precision, and the line widths of the circuit patterns are being made smaller to meet the demand for more highly-integrated semiconductor devices. Moreover, the forming of such circuit patterns involves depositing or growing different layers of materials one atop the other on a wafer. As a result, the surface of the wafer becomes uneven. If not attended to, the uneven surface would cause alignment errors in a photolithography process, for example, whereby process failures would occur. In view of this, the wafer needs to be planarized between successive ones of the unit processes.

One known process of planarizing a wafer is chemical mechanical polishing (CMP). The CMP process employs a polishing pad to polish and planarize the surface of the wafer during the fabrication of semiconductor devices.

As shown in FIG. 1, a polishing pad 10 used in a typical polishing process is adhered to the top of a plate 12, which is rotated at a high speed. A slurry S is supplied towards a central region of the polishing pad 10. The slurry should be uniformly distributed across the upper surface of the polishing pad 10 by centrifugal force. At the same time, a wafer W adhering to a polishing head 14 is pressed by the head 14 against the surface of the polishing pad 10, is rotated at a high speed, and is moved across the polishing pad 10 between the central region of the polishing pad 10 and the outer peripheral region thereof. The wafer W is maintained parallel to the surface of the polishing pad 10, i.e., is maintained in a horizontal orientation, by a gimbal 16 of the polishing head 14.

As described above, the main purpose of polishing the wafer W is to planarize the surface of the wafer W. Therefore, the surface of the polishing pad 10 must be continuously maintained flat and even, and the slurry S must be uniformly distributed across the surface of the polishing pad 10.

The surface state of the polishing pad 10 is maintained by a conditioning head 18, which is located at one side of and above the polishing pad 10. The conditioning head 18 is driven to cut the surface of the polishing pad 10 during the polishing process or periodically. Furthermore, as shown in FIG. 2, the slurry S is distributed uniformly across the surface of the polishing pad 10 by a groove G, as the slurry S flows form the center of rotation of the polishing pad 10 to the outer periphery thereof under the centrifugal force imparted to the slurry S due to the high rotational speed of the plate 12. Furthermore, the polishing pad 10 comprises polymeric material having micro-cavities B. The micro-cavities B are exposed over the entire surface of the polishing pad 10, as shown in FIGS. 3 and 4. Accordingly, the slurry S flows in and out of the micro-cavities B as well as the grooves G so as to be distributed uniformly between the polishing pad 10 and the wafer W.

Now, the structure of the polishing pad 10 will be explained in more detail with reference to FIG. 3. The polishing pad 10 is a structure having multiple layers whose physical properties differ from each other. The multiple layers include a polishing layer 10*a* that faces the wafer W during the polishing process, a support layer 10*b* adhered to the top of the plate 12, and an epoxy layer 10*c* interposed between the support layer 10*b* and the polishing layer 10*a* to bond the two layers 10*a* and 10*b*. The polishing layer 10*a* is typically formed of a polyurethane material having micro-cavities B. The surface of the polishing layer 10*a* is maintained in tight contact with the surface of the wafer W because the micro-cavities B exposed at the top surface help impart an elastic and flexible state to the top portion of the polishing layer 10. The support layer 10*b* has a porous structure, which is more elastic and flexible than the polishing layer 10*a*, and is compressed by the gimbal 16 of the polishing head 18 and the wafer W held thereby. The support layer 10*b* thus urges the polishing layer 10*a* back into its initial state.

During the polishing process, some of the slurry S that has flowed across the polishing pad 10 is flung off the pad by centrifugal force. However the rest of such slurry flows from the surface of the polishing layer 10*a* down along the sidewall thereof. The slurry S reaches the support layer 10*b*, which is relatively thick, and penetrates into the support layer 10*b* through its pores. The penetration of the slurry S into the support layer 10*b* damages the adhesiveness between the support layer 10*b* and the plate 12. As a result, the support layer 10*b* and the plate 12 separate at their interface, and the elasticity of the support layer 10*b* decreases at regions of the interface filled by the slurry S.

To avoid this potential problem, the adhesive strength between the support layer 10*b* and the plate 12 could be increased. However, such a measure would make it difficult to separate the polishing pad 10 from the plate 12 when replacing the worn polishing pad 10. Furthermore, such a measure would give rise to many other problems such as the long time it would require to clean the surface of the plate 12 after the worn polishing pad was removed therefrom.

Regardless, the support layer 10*b* should be very tightly adhered to the surface of the plate 12. However, even if specific efforts were taken to tightly adhere the support layer 10*b* to the plate 12, local air spaces would still be present therebetween because the support layer 10*b* is of a porous flexible material. The air spaces adversely affect the elasticity of the support layer 10*b*, which can result in failures in the process of polishing the wafer W. This phenomenon may last even after the surface of the polishing pad 10 is conditioned by the conditioning head 18.

Furthermore, the slurry has been found to penetrate the support layer 10*b* even as far as a detecting unit 20 for detecting the degree to which the wafer W has been polished. The detecting unit 20, as shown in FIGS. 2 and 4 comprises a detecting window 20*a*. A predetermined local region of the polishing pad 10 is cut out from the polishing layer 10*a* down to the plate 12, the projection window 20*a* is inserted into the cut-out region, and the projection window 20*a* is adhered to the layers of the pad. The detecting unit 20 also comprises a photo detector 20*b*, 20*c* disposed on the plate 12. The photo detector 20*b*, 20*c* intermittently emits probe light onto the surface of the wafer W through the projection window 20*a*, and collects the light reflected from the surface of the wafer W.

The projection window 20*a* must be tightly adhered to the polishing pad 10. However, if the projection window 20*a* is not strongly adhered to the polishing pad 10, and the area of contact area between them is deformed by the downward force exerted on the polishing pad 10 by the polishing head 14 and the wafer W, the projection window 20 may separate from the polishing pad 10. As a result, some of the slurry S flows into the support layer 10*b* through the area of separation between the projection window 20 and the polishing pad 10.

As a possible countermeasure, the adhesive strength between the polishing pad 10 and the projection window 20*a* could be enhanced. However, in this case, the physical property of the area of contact between the polishing pad 10 and the projection window 20*a* would differ significantly from those portions of the pad 10 around the cut-out area. The portion of the surface of the wafer W passing over the region of the polishing pad corresponding to the cut-out would be polished to a degree different from other portions of the wafer surface.

Still further, the surface of the support layer 10*b* of the polishing pad 10 loses its elasticity and forms more and more dimples over time because it is continuously compressed by the polishing head 14. As a result, the polishing layer 10*a* of the polishing pad 10 needs to be cut frequently by the conditioning head 18 to eradicate the dimples, thereby reducing the useful life of the polishing pad 10.

SUMMARY OF THE INVENTION

Therefore, it is an object of the present invention to provide a polishing pad of CMP equipment, which will uniformly compress when a wafer is pressed against the polishing pad by a polishing head during a polishing process, whereby the surface of the wafer will be evenly polished.

Another object of the present invention is to provide a polishing pad of CMP equipment, which has a relatively long useful life.

According to one aspect, the present invention provides a polishing pad comprising a plate-shaped elastically deformable support layer comprising a mixture of magnetic powder and a bonding agent containing synthetic resin, a polishing layer comprising a polyurethane and having micro-cavities dispersed throughout, and an adhesive layer interposed between the support layer and the polishing layer. The adhesive layer comprises an epoxy resin that adhesively fixes the polishing layer to the support layer.

Preferably, the magnetic powder of the support layer may be barium ferrite or strontium ferrite, or a mixture thereof. The bonding agent preferably is either plastic or rubber.

The polishing pad of the present invention may further include a through-hole formed in the support layer and the adhesive layer to expose a detecting unit provided in the plate. In this case, the polishing layer has a hole disposed directly above and open to the through-hole. The width of the hole in the polishing layer is greater than that of the through-hole. In addition, a projection window is received in the ole in the polishing layer as adhered to the inner wall of layer that defines the hole. The projection window is seated on and adhered to an upper peripheral portion of the support layer that extends around the top of the through hole.

According to another aspect, the present invention provides a polishing pad of CMP equipment comprising a plate-shaped elastically deformable support layer comprising a porous material of polyurethane, a polishing layer disposed on top of the support layer, an adhesive layer interposed between the support layer and the polishing layer and comprising an epoxy resin that adhesively fixes the polishing layer to the support layer and a protective film extending along outer peripheral side walls of said adhesive layer and the support layer. The protective film extends between the bottom of the outer peripheral side wall of the polishing layer and at least the bottom of the outer peripheral side wall of the support layer. The polishing layer may comprise a polyurethane having micro-cavities disposed throughout.

The protective film may be extended beyond the bottom of the outer peripheral side wall of the support layer further downward. In particular, the film is adhered to layers of the polishing pad, and may extend to the peripheral sidewall of the plate at a location where the plate is adhered to by the support layer.

BRIEF DESCRIPTION OF THE DRAWINGS

The above and other features and advantages of the present invention will become more apparent to those of ordinary skill in the art from the following detailed description of the preferred embodiments thereof made with reference to the attached drawings in which.

DETAILED DESCRIPTION OF THE PREFERRED EMBODIMENTS

The present invention will now be described more fully hereinafter with reference to the accompanying drawings. Note, like numbers designate like elements throughout the drawings.

Figure 1:
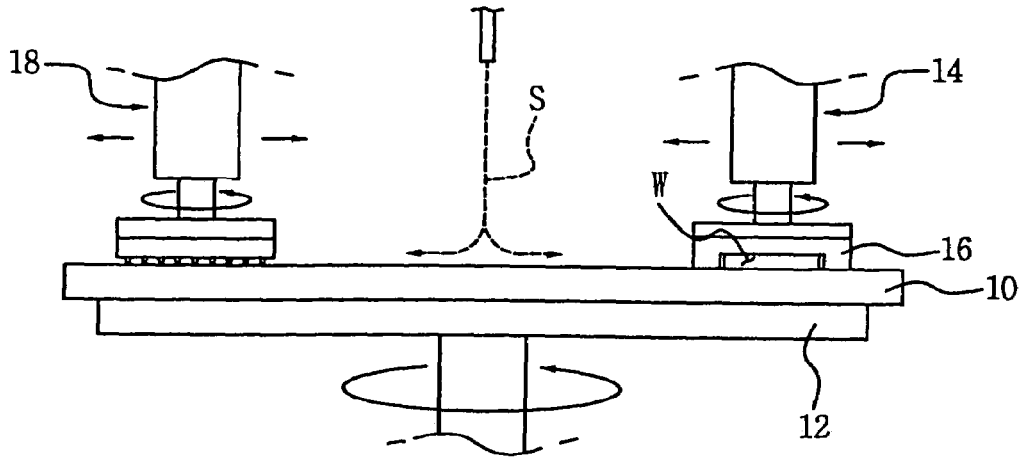
FIG.1 (PRIOR ART)
FIG. 1 a schematic side view of conventional CMP equipment.
Figure 2:
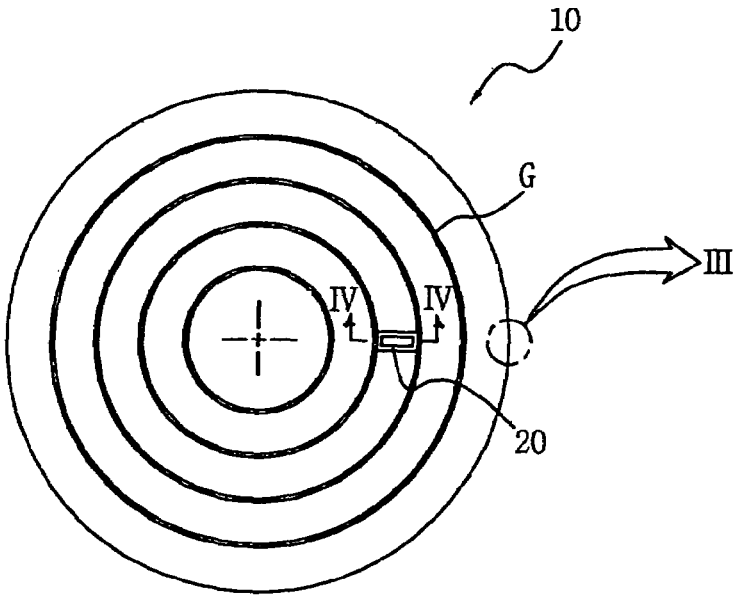
FIG.2 (PRIOR ART)
FIG. 2 is a plan view of the polishing pad of the CMP equipment shown in FIG. 1.
Figure 3:
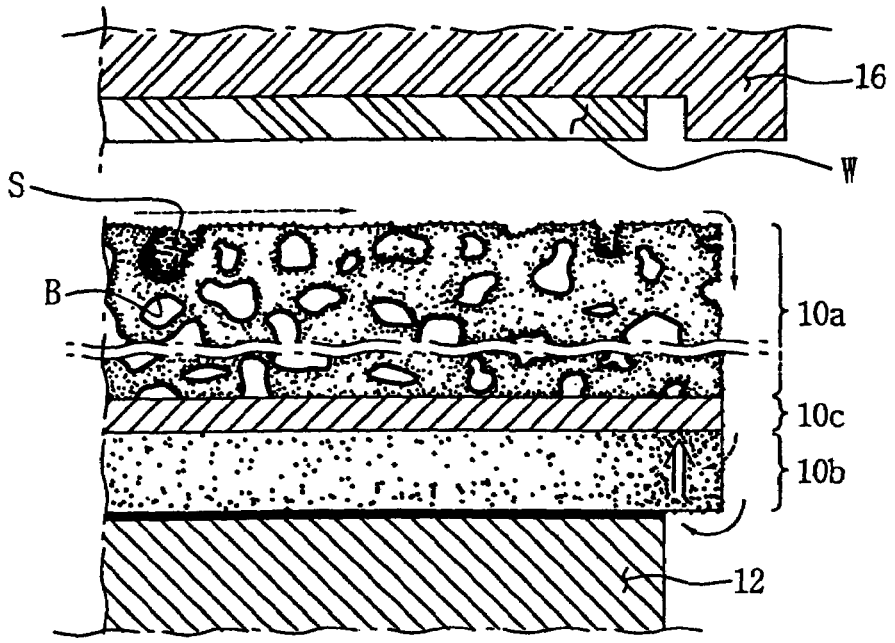
FIG.3 (PRIOR ART)
FIG. 3 is a sectional view of a circled portion III of the polishing pad shown in FIG. 2.
Figure 4:
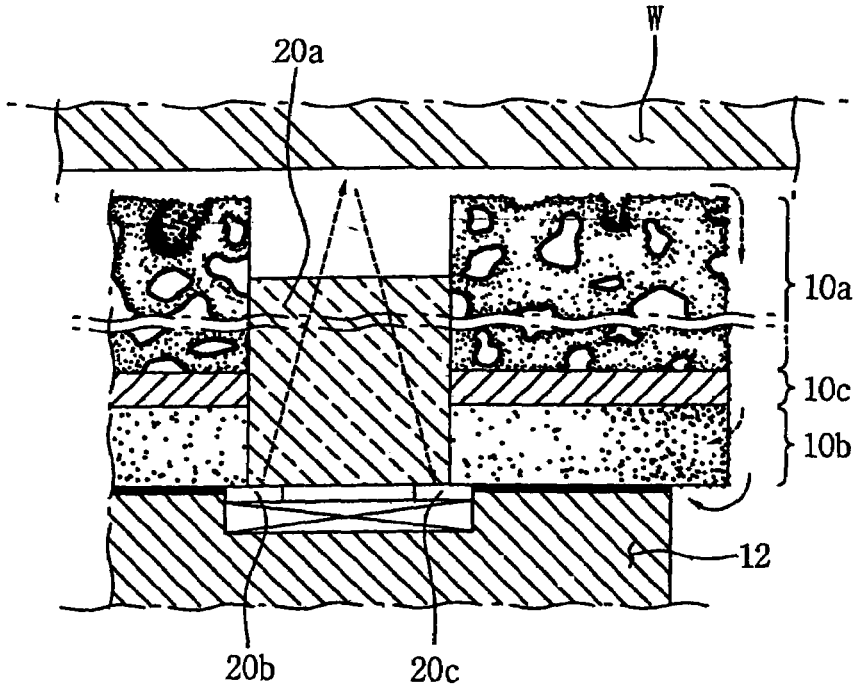
FIG.4 (PRIOR ART)
FIG. 4 is a sectional view of the polishing pad, taken along line IV—IV of FIG. 2 and illustrating an EPD window of the pad.
Figure 5:
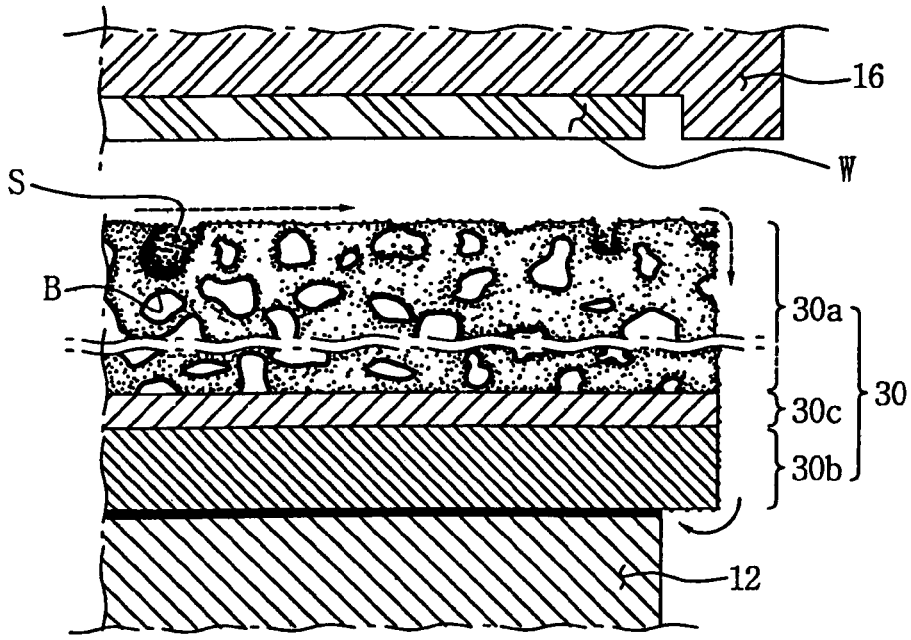
FIG. 5 is a sectional view of a portion of one embodiment of a polishing pad according to the present invention.

Referring now to FIG. 5, a polishing pad 30 for use in CMP equipment according to the present invention comprises an elastic support layer 30*b* to be adhered to the top of a plate 12 of the CMP equipment, a polishing layer 30*a* that is to face a wafer W guided by a polishing head 14 of the CMP equipment, and an adhesive layer 30*c* interposed between the polishing layer 30*a* and the support layer 30*b* for enhancing the adhesiveness between the two layers 30*a*, 30*b*.

The elastic support layer 30*b* is a molded article formed of a mixture of magnetic powder and a bonding agent comprising a synthetic resin. The magnetic powder may be barium ferrite, strontium ferrite, or a mixture thereof. The bonding agent may be a resin-containing plastic or rubber, or a mixture thereof. The support layer 30*b* is formed by molding a mixture of the above ingredients in a mold having the form of a plate. The resulting molded article is, in effect, a rubber magnetic pad.

The support layer 30*b*, being, in effect, a rubber magnetic pad, has an elasticity capable of providing a sufficient restoring force against the force exerted by the polishing head of the CMP equipment on the top of the polishing layer 30*a*. Furthermore, the support layer 30*b* hardly has any air spaces, and has a good tensile strength relative the plate 12, due to the magnetic material thereof. Also, its surface is slippery. Thus, the support layer 30*b* will closely adhere to the plate 12 and yet, advantageously, it is also readily detachable from the plate 12.

On the other hand, the polishing layer 30*a* may be of a polymeric material such as a polyurethane provided with micro-cavities B. The micro-cavities B near the top surface of the polishing layer 30*a* are exposed and opened when the top surface of the polishing layer 30*a* is cut by the conditioning head 18 of the CMP equipment. Thus, the top surface of the polishing layer 30*a* will hold the slurry S as the slurry flows across the pad 30. As the top surface of the polishing layer 30*a* is continuously or periodically cut off by the conditioning head 18, large numbers of the micro-cavities B continue to become exposed, whereby the top portion of the polishing layer 30*a* remains more elastic and more flexible than the lower portion of the polishing layer 30*a*. Accordingly, the top portion of the polishing layer 30*a* can maintain close contact with the surface of the wafer W.

The adhesive layer 30*c* is typically made of an epoxy resin, and acts as a primer for bonding the polishing layer 30*a* to the support layer 30*b*. The adhesive layer 30*c* is very thin compared to each of the support layer 30*b* and the polishing layer 30*a*.

Figure 6:
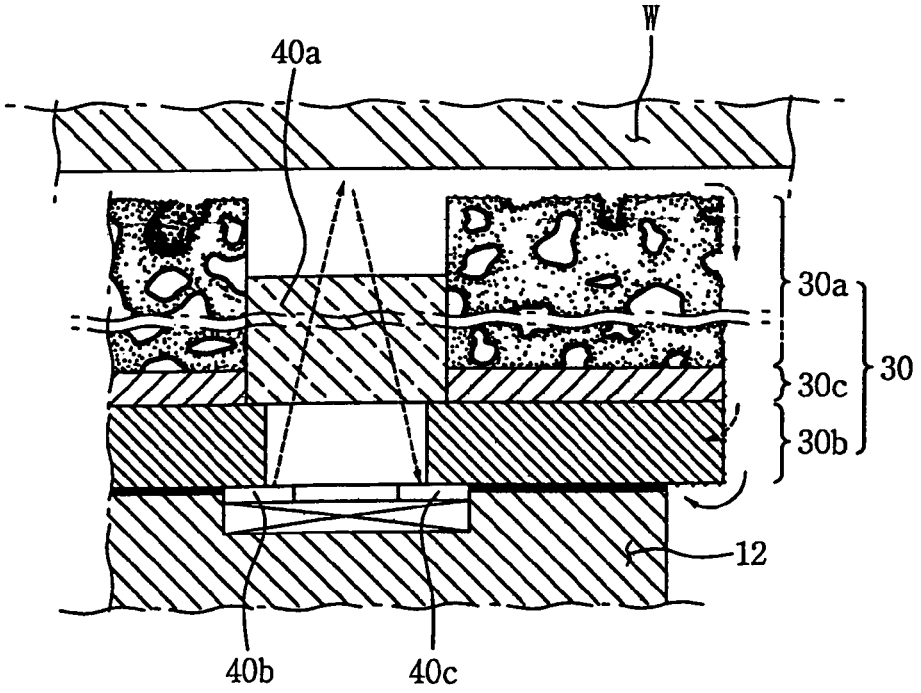
FIG. 6 is a sectional view of another part of the polishing pad according to the present invention, illustrating an EPD window of the pad.

Now referring to FIG. 6, a predetermined portion of the support layer 30*b* has a through-hole, the size of which is just wide enough to expose photo transmitter 40*b* and photo receiver 40*c* of a photo-detector 40 (40*a*, 40*b*, 40*c*). The photo transmitter 40*b* and photo receiver 40*c* are installed in the plate 12 of the CMP equipment. In addition, the polishing layer 30*a* has a corresponding hole located over and open to the through-hole of the support layer 30*b*. The hole in the polishing layer 30*a* is wider than the through-hole of the support layer 30*b*. Further, a projection window 40*a* of the photo-detector 40 is received in the hole of the polishing layer 30*a* as disposed against and adhered to an inner wall of the polishing layer 30*a* that defines the hole. Also, the thickness of the projection window 40*a* is just smaller than that of the polishing layer 30*a*. The projection window 40*a* is also adhered to a portion of the support layer 30*b* that extends around the upper periphery of the through-hole and is exposed by the hole in the polishing layer 30*a*.

The projection window 40*a* allows the surface of a wafer W passing above the polishing pad to be irradiated with light from photo transmitter 40*b*, and light reflected from the surface of the wafer W to be received by photo receiver 40*c* so that the degree to which the wafer W has been polished can be detected.

Figure 7:
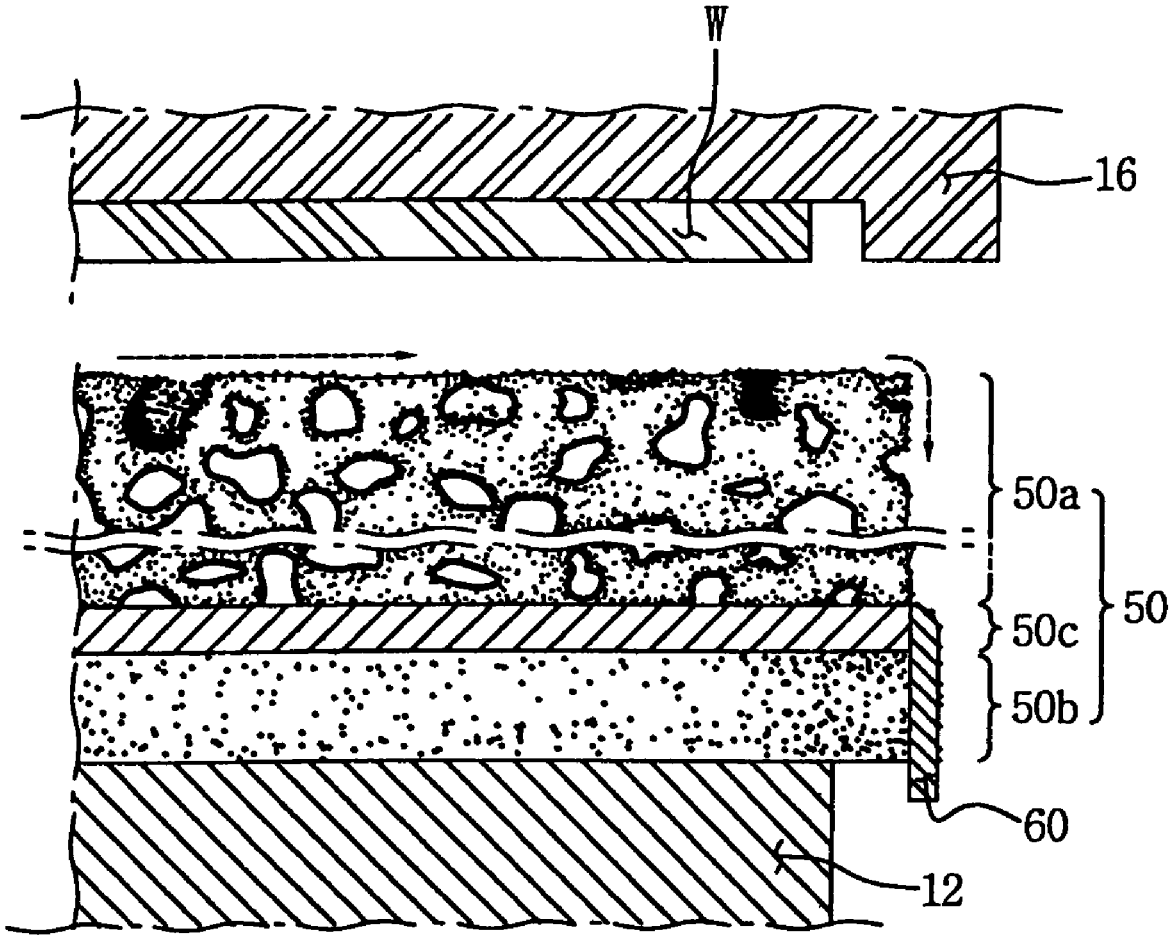
FIG. 7 is a sectional view of a portion of a second embodiment of a polishing pad according to the present invention.

Now, another embodiment of a polishing pad according to the present invention will be described with reference to in FIG. 7. The polishing pad 50 comprises a support layer 50*b* to be adhered to the top of a plate 12 of the CMP equipment, a polishing layer 50*a* that is to face a wafer W guided by a polishing head 14 of the CMP equipment, and an adhesive layer 50*c* interposed between the polishing layer 50*a* and the support layer 50*b* for enhancing the adhesiveness between the two layers 50*a*, 50*b*.

The support layer 50*b* is a molded article in the form of a plate, comprises a polyurethane having pores, and has elasticity such that it will restore itself to its initial shape after being compressed, i.e., is elastically deformable. The polishing layer 50*a* is formed of a polyurethane having a large number of micro-cavities that are substantially larger in average diameter than the pores of the support layer 50*b*. The adhesive layer 50*c* is formed of an epoxy resin.

Furthermore, a film 60 is disposed along the outer peripheral side edges of the adhesive layer 50*c* and the support layer 50*b*, as extending from the bottom of the polishing layer 50*a* over the outer peripheral side edge of the support layer 50*b*. The film 60 is impervious to the slurry S and thus, functions to prevent the slurry S from penetrating into the support layer 50*b*. The upper portion of the film 60 is adhered to the adhesive layer 50*c*.

Figure 8:
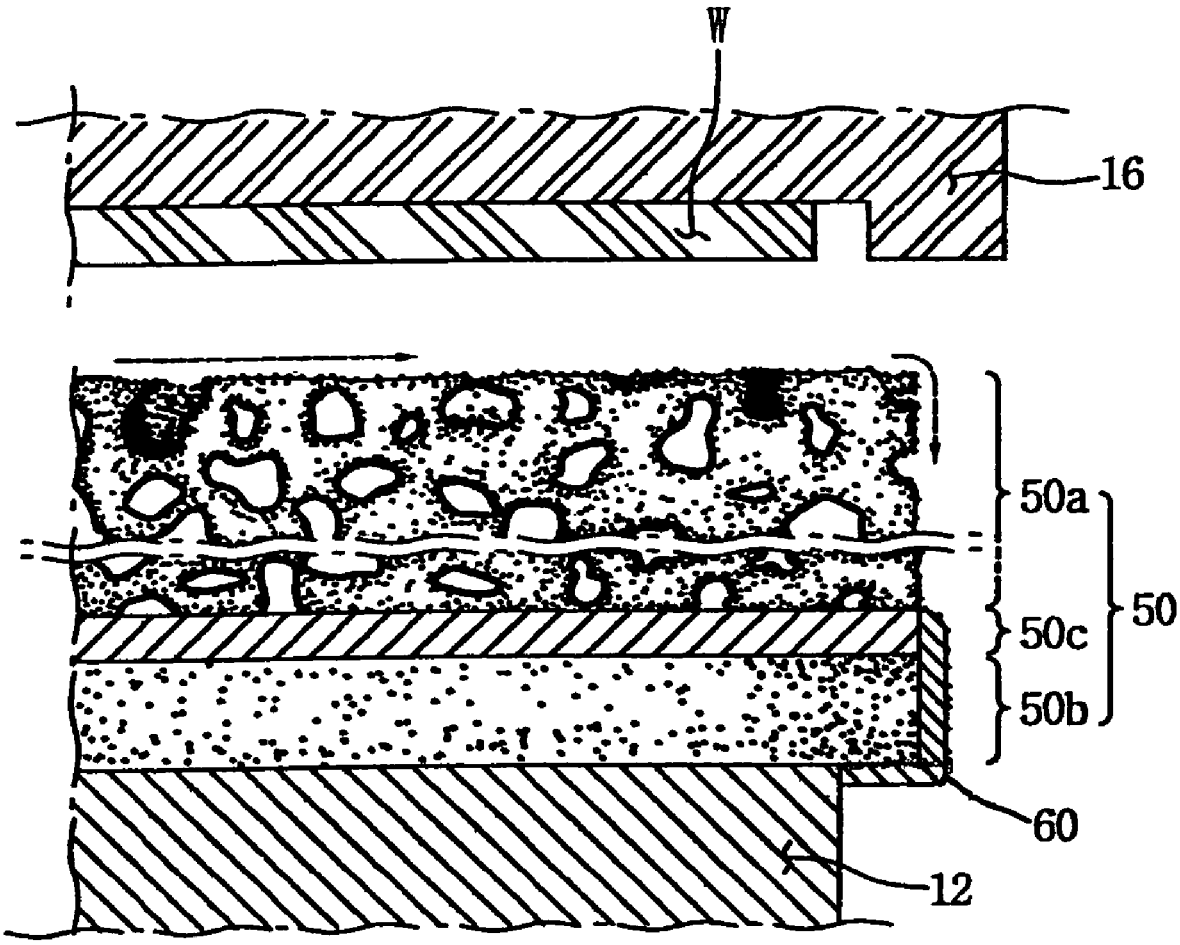
FIG. 8 is a sectional view of a portion of modified form of the second embodiment of the polishing pad according to the present invention.

Also, the film 60 may extend beyond the bottom of the outer peripheral side edge of the support layer 50*b*. As such, any slurry S flowing along the outer surface of the film 60 will be prevented from touching the support layer 50*b*. Furthermore, as shown in FIG. 8, the bottom portion of the film 60 may curve downward into contact with the outer peripheral sidewall of the plate 12 so as to cover the support layer 50*b*. The film 60 preferably contacts the plate 12 at the point where the support layer 50*b* is adhered to the plate 12. Also, the tolerance between the film 60 and the support layer 50*b* is preferably great enough so that the film 60 will not affect the physical properties of the support layer 50*b*.

As described above, according to the first embodiment of the present invention, the support layer of the polishing pad is made of magnetic rubber. Therefore, the polishing pad will adhere well to the rotary plate of the CMP equipment. Furthermore, slurry is prevented form penetrating into the polishing pad including at that portion of the pad provided with the projection window. Accordingly, the surface of the polishing pad is prevented form being deformed unevenly. Therefore, the mechanical forces used to polish the wafer are uniformly distributed across the surface of the wafer, thereby improving the efficacy of the polishing process.

Further, the polishing pad of the present invention has a comparatively long useful life because the support layer, in effect formed of a rubber magnet, does not deform irregularly. Thus, the support layer helps maintain an even surface a the top of the polishing pad. Accordingly, the upper surface of the polishing layer can be conditioned even by only cutting off a thin section thereof.

Furthermore, according to the second embodiment of the present invention, a protective film covers the sides of the polishing pad. Accordingly, the slurry can be prevented from flowing into the porous support layer, even when the support layer has the same composition as that of a conventional polishing pad.

Although the present invention has been particularly shown and described with reference to the preferred embodiments thereof, it will be understood that changes in form and details may be made thereto without departing from the true spirit and scope of the present invention as defined by the appended claims.

What is claimed is:

1. A polishing pad of chemical mechanical polishing equipment, comprising:

a plate-shaped elastically deformable support layer comprising a mixture of magnetic powder and a bonding agent containing synthetic resin;

a polishing layer disposed on top of the support layer, and comprising a polyurethane having micro-cavities dispersed throughout; and an adhesive layer interposed between the support layer and the polishing layer, and comprising an epoxy resin that adhesively fixes the polishing layer to the support layer.

2. The polishing pad as claimed in claim 1, wherein the magnetic powder of the support layer is of at least one material selected from the group consisting of barium ferrite and strontium ferrite, and the bonding agent is of plastic or rubber.

3. The polishing pad as claimed in claim 1, wherein the support layer and the adhesive layer together define a through-hole, and the polishing layer has a hole therethrough that is disposed over and is open to the through-hole, the hole in said polishing layer having a width that is greater than a width of the through-hole as taken in a direction along the interface between the layers, and further comprising a projection window received in the hole in said polishing layer and seated against an upper peripheral portion of the support layer.

4. In chemical mechanical polishing equipment, the combination of a rotatable plate, a polishing pad adhered to said plate, and a polishing head disposed above said rotatable plate for use in pressing a wafer against the polishing pad, wherein said polishing plate comprises a plate-shaped elastic support layer comprising a mixture of magnetic powder and a bonding agent containing synthetic resin, said support layer being self-adhered to said plate, a polishing layer disposed on top of the support layer and having an upper surface facing and exposed to said polishing head, said polishing layer comprising a polyurethane having micro-cavities dispersed throughout, and an adhesive layer interposed between the support layer and the polishing layer, and comprising an epoxy resin that adhesively fixes the polishing layer to the support layer.

5. The combination as claimed in claim 4, wherein the magnetic powder of the support layer of said polishing pad is of at least one material selected from the group consisting of barium ferrite and strontium ferrite, and the bonding agent is of plastic or rubber.

6. The combination as claimed in claim 4, and further comprising photo-detecting elements disposed in said plate, and wherein the support layer and the adhesive layer of said polishing pad together define a through-hole that exposes said photo-detecting elements, and the polishing layer has a hole therethrough that is disposed over and is open to the through-hole, the hole in said polishing layer having a width that is greater than a width of the through-hole as taken in a direction along the interface between the layers, andthe polishing pad further comprises a projection window received in the hole in said polishing layer and seated against an upper peripheral portion of the support layer.

* * * * *